US006782638B1

(12) United States Patent
Svenland

(10) Patent No.: US 6,782,638 B1
(45) Date of Patent: Aug. 31, 2004

(54) METHOD AND DEVICE FOR SUPPLYING STEAM TO THE DRYING SECTION IN A PAPERMAKING MACHINE

(75) Inventor: Torsten Svenland, Bromölla (SE)

(73) Assignee: Stora Enso AB, Falun (SE)

( * ) Notice: Subject to any disclaimer, the term of this patent is extended or adjusted under 35 U.S.C. 154(b) by 0 days.

(21) Appl. No.: 10/110,076

(22) PCT Filed: Oct. 6, 2000

(86) PCT No.: PCT/SE00/01937

§ 371 (c)(1),
(2), (4) Date: May 14, 2002

(87) PCT Pub. No.: WO01/27388

PCT Pub. Date: Apr. 19, 2001

(30) Foreign Application Priority Data

Oct. 8, 1999 (SE) ..... 9903627

(51) Int. Cl.[7] ..... F26B 5/04

(52) U.S. Cl. ..... 34/411; 60/677; 34/124

(58) Field of Search ..... 34/411, 83, 84, 34/114, 119, 122, 124; 60/677; 415/144, 145; 417/186, 187, 191

(56) References Cited

U.S. PATENT DOCUMENTS 4,253,245 A * 3/1981 Perrault ..... 34/552
4,447,964 A 5/1984 Gardner
4,615,122 A * 10/1986 Sherrod et al. ..... 34/18
5,210,958 A * 5/1993 Bond et al. ..... 34/18
5,636,449 A * 6/1997 Gaddis et al. ..... 34/124

FOREIGN PATENT DOCUMENTS

GB 2155164 A 9/1985

* cited by examiner

*Primary Examiner*—Henry Bennett
*Assistant Examiner*—Camtu Nguyen
(74) *Attorney, Agent, or Firm*—Burns, Doane, Swecker & Mathis, LLP

(57) ABSTRACT

A method for increasing the drying capacity of a steam group (6) in a drying section of a pulp or paper machine. According to the method, a main steam flow (3) having a first steam pressure is fed to the steam group (6), the main steam flow (3) is conducted to at least one thermocompressor (9), which is driven by motive steam (4) having a second steam pressure, which is driven by motive steam (4) having a second steam pressure, which is higher than the first steam pressure, and the output steam (13) of said at least one thermocompressor (9) is fed to the steam group (6), the steam pressure of the steam that is fed to the steam group (6) being higher than the first steam pressure.

20 Claims, 5 Drawing Sheets

METHOD AND DEVICE FOR SUPPLYING STEAM TO THE DRYING SECTION IN A PAPERMAKING MACHINE

TECHNICAL FIELD

The present invention concerns a method and a device for increasing the drying capacity of a pulp or paper machine.

TECHNICAL BACKGROUND

In a pulp or paper machine liquid pulp, so-called stock, is supplied to a head box which distributes the pulp in a thin layer onto a wire. The wire and its associated rolls and suction boxes are called a wire section. In the wire section, the pulp is drained and a web of pulp forms. After the wire section, the web passes a so-called press section, in which more water is removed by pressing. Subsequently, the web is passed on to a drying section.

In the drying section, the web is passed over a number of drying cylinders which are heated by means of steam. The web is usually held against the drying cylinders by means of dryer wires. The drying section is usually divided into a number of drying groups, where each drying group is made up of a number of drying cylinders and a wire. Another way of dividing the drying section is to group the drying cylinders in steam groups, in which each steam group is supplied with steam from the same pipe. The drying groups may coincide with the steam groups.

Steam is supplied to the papermaking machine from a principal steam conduit under constant pressure. It should be noted that all indications of pressure hereinafter relate to overpressure, unless otherwise stated. In most cases this steam, which originates from a steam boiler, has passed one or more turbines, which have converted some of the energy content of the steam into electric power. The steam produced by the boiler usually has a pressure of about 3.5–6 MPa, but pressures of up to about 10 MPa can be found. This steam is called high-pressure steam. From the turbine, steam having two different pressure levels is often conducted: intermediate-pressure steam with a pressure of about 1.0–1.3 MPa and low-pressure steam with a pressure of about 0.2–0.5 MPa. When making thermomechanical pulp (TMP), steam is circulated from the TMP refiner with a relatively low pressure, in the order of 0.15 MPa. The low-pressure steam is conducted to the steam users in the pulp or paper machine. The steam users can, for instance, be said drying cylinders.

Each drying cylinder has an inlet for steam and one or more discharge pipes (so-called siphons) or discharge shovels arranged in the cylinder. Each of the siphons, which can be stationary or rotating, has an opening located near the internal cylinder surface of the cylinder so that it can take up the condensate formed in the drying cylinder. If the pressure drop over the siphon is sufficient, the condensate will be pressed up through the siphon and discharged into one or more condensate vessels/steam separators. If the siphon is empty, steam flows out of the siphon and entrains newly formed condensate in droplet form, which is removed in the condensate vessel. The steam which is removed from a drying cylinder via the siphon is called residual steam (blow-through steam) and it has a lower pressure than the steam supplied to the drying cylinder due to the pressure drop in the drying cylinder, siphon and condensation vessel.

In some situations, it is desirable for economic reasons to reuse the residual steam with a view to using the heat still contained therein, in which case residual steam is sometimes recirculated to the same or one or several adjacent steam groups. However, more often than not this or these steam groups should be supplied with steam having a higher pressure than the pressure of the residual steam. To achieve this, some kind of compressor is installed, which increases the pressure of the recycled residual steam so that it attains the same pressure as the rest of the steam that is fed to the steam group in question. It is, for instance, possible to use a so-called steam ejector which utilises steam with a higher pressure, normally intermediate-pressure steam, to increase the pressure of the residual steam. If residual steam is to be returned, it is necessary to increase the pressure of the residual steam since steam with a certain pressure cannot flow by itself to a point with a higher pressure. The purpose of this return of residual steam is to reuse the heat which is still present in the residual steam after it has passed a first steam group. The energy loss and the investment cost due to the use of the compressor or the ejector are compared with the value of the residual heat of the residual steam when deciding whether to return the residual steam or not. In the above-described system for returning residual steam, the residual steam constitutes a minor part of the total amount of steam supplied to the steam group.

In the above-described prior-art system, there are occasions when the pulp or paper machine is "drying limited", i.e. the capacity of the drying section restricts the speed of the web through the papermaking machine. These situations may, for instance, occur when it is desirable to increase the speed of the machine or obtain higher grammage, if the press dry solids content is reduced or if the output dry solids content of the drying section is to be increased. Often only one or a few steam groups limit the maximum production/drying capacity, e.g. the maximum speed. Which steam group or steam groups limit the speed depends on the reason why the machine is "drying limited". A limited drying capacity can be avoided, for instance, by lengthening the drying section or by increasing the energy content of the supplied steam, which is usually performed by increasing the steam pressure.

To lengthen the drying section means a great investment, a great fall in production due to the stoppage during reconstruction and results in a machine having a drying section which in many cases is over-dimensioned. Often this solution is not justifiable from an economic point of view.

It is possible to increase the steam pressure of the system by installing a mechanical compressor which raises the pressure of the steam flow that passes the compressor, by increasing the pressure of the low-pressure steam in the entire system or by using the steam in the intermediate-pressure system for the drying groups. However, these solutions result in great costs. Since different drying groups (one or more) can limit the drying capacity of the machine in different cases, it is necessary to install compressors for each of the drying groups, which leads to great investment costs. Relatively high increases in pressure and large steam flows require large and expensive compressors. To increase the pressure of the low-pressure steam or use the intermediate-pressure steam also leads to great costs. A pressure increase of the low-pressure steam corresponds to a reduction of the power available to the turbine. Since the steam flows in a paper machine are often large, also a marginal pressure increase causes great differences in the electric power generated by the turbine, which in turn leads to great economic loss. To increase the pressure is a more or less permanent measure, whereas the limited drying capacity and thus the need of steam with increased pressure often occurs only in certain situations. In addition, the maximum permissible pressure in existing installations is often not much higher than the pressure in normal operation. Moreover, any pressure increase in the steam distribution system often makes it necessary to replace several components in the steam distribution system. Similar problems are associated with the use of intermediate-pressure steam, as the power available to the turbine decreases since the usable steam flow decreases, and in most cases the steam distribution system for intermediate-pressure steam is not dimensioned for the steam flows that are required if the intermediate-pressure steam is to be used for the drying groups.

Thus, a great drawback of prior-art drying systems in pulp and paper machines is that the known methods of increasing the drying capacity are much too expensive.

SUMMARY OF THE INVENTION

One object of the present invention is to define a solution to the above-described problems.

According to a first aspect of the invention, this object is achieved by a method for increasing the drying capacity of a steam group in a drying section of a pulp or paper machine, characterised in that a main steam flow having a first steam pressure is fed to the steam group, that the main steam flow is conducted to at least one thermocompressor, which is driven by motive steam having a second steam pressure, which is higher than the first steam pressure, and that the output steam of said at least one thermocompressor is fed to the steam group, the steam pressure of the steam that is fed to the steam group being higher than the first steam pressure.

According to a second aspect of the invention, the above-mentioned object is achieved by a device for increasing the drying capacity of a steam group in a drying section of a papermaking machine, comprising a main steam pipe for supplying a main steam flow to the steam group, characterised in that the device further comprises at least one thermocompressor having an inlet for steam with a first steam pressure, an inlet for motive steam with a second steam pressure and an outlet for output steam, which outlet is connected to the steam group, a steam pipe for supplying motive steam to the motive steam inlet of said at least one thermocompressor, a branch, between the main steam pipe and said inlet of said at least one thermocompressor for steam with a first steam pressure, for conducting the main steam flow to said at least one thermocompressor.

Additional characteristic features and advantages of the invention are stated in the dependent claims and the description below.

Since the main steam flow is conducted to a first thermocompressor, which is driven by motive steam having a pressure that is higher than the pressure of the main steam flow, the steam group can be fed with steam having a pressure that exceeds the pressure of the main steam flow, which means that the drying capacity of the steam group is increased. As motive steam, use can, for instance, be made of intermediate-pressure steam. Alternatively, the invention can be utilised to lower the pressure of the main steam flow with maintained drying capacity by using a thermocompressor.

A thermocompressor is a type of jet ejector in which relatively high-pressure motive steam imparts some of its energy to a main steam flow of steam with a lower pressure. The thermocompressor is made up of three basic components; a nozzle in which the motive steam is allowed to accelerate to high velocity, resulting in its pressure decreasing to a pressure approximate to that of the main steam flow, a mixing section in which the motive steam joins the main steam flow and entrains the same, and a diffusor in which the jet momentum is converted into an increase in pressure. A thermocompressor only needs a relatively limited amount of motive steam, with a higher pressure, to increase the pressure of the main steam flow. As a result, the loss in electric power available from the turbine will not decrease markedly. Besides, a thermocompressor is much simpler and less expensive than the mechanical compressors needed for the same steam demand.

To achieve the highest possible degree of efficiency and economy, it is suitable to dimension a first thermocompressor for the pressure increase level and the steam capacity mostly required.

When a temporary need for additional pressure rise/steam capacity occurs, it is possible to lead a relatively small amount of the motive steam past the thermocompressor directly to the steam group.

Additional pressure rise/steam capacity can also be provided by conducting some of the main steam flow to a second thermocompressor which is connected in parallel to the first thermocompressor.

BRIEF DESCRIPTION OF THE DRAWINGS

The invention will now be described in more detail with reference to the accompanying schematic drawings which, for the purpose of exemplification, show a currently preferred embodiment of the invention.

FIG. 2 shows how steam is supplied to a steam group in normal operation.

FIG. 3 shows how steam with increased pressure is supplied to a steam group.

FIG. 4 shows how steam with increased pressure is supplied to a steam group in a case where somewhat more steam than normal is needed.

FIG. 5 shows how steam is supplied to a steam group according to an alternative embodiment of the invention.

DESCRIPTION OF THE PREFERRED EMBODIMENTS

Figure 1:
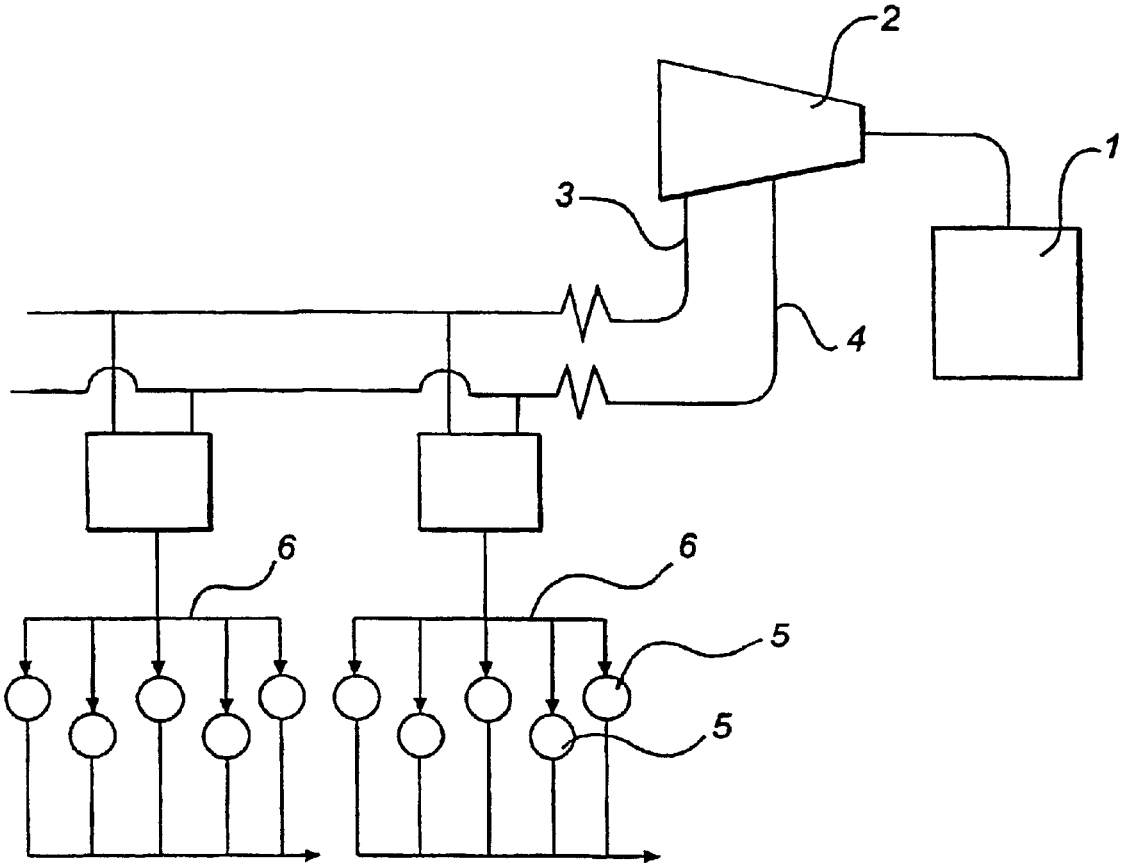
FIG. 1 schematically shows a steam distribution system provided with a device according to the invention.

As seen in FIG. 1, steam is produced in a steam boiler 1. The steam is then passed on to a turbine 2. In the turbine 2, some of the energy content of the steam is converted into electric power. From the turbine 2, low-pressure steam is conducted in a low-pressure steam pipe 3 and intermediate-pressure steam is conducted in an intermediate-pressure steam pipe 4. The low-pressure steam has a pressure in the order of 0.1–0.6 MPa and the intermediate-pressure steam has a pressure in the order of 0.5–1.5 MPa. The steam pipes 3, 4 then lead the steam to a pulp or paper machine, where it is used, among other things, to heat drying cylinders 5. A number of drying cylinders 5 are arranged in steam groups 6.

Figure 2:
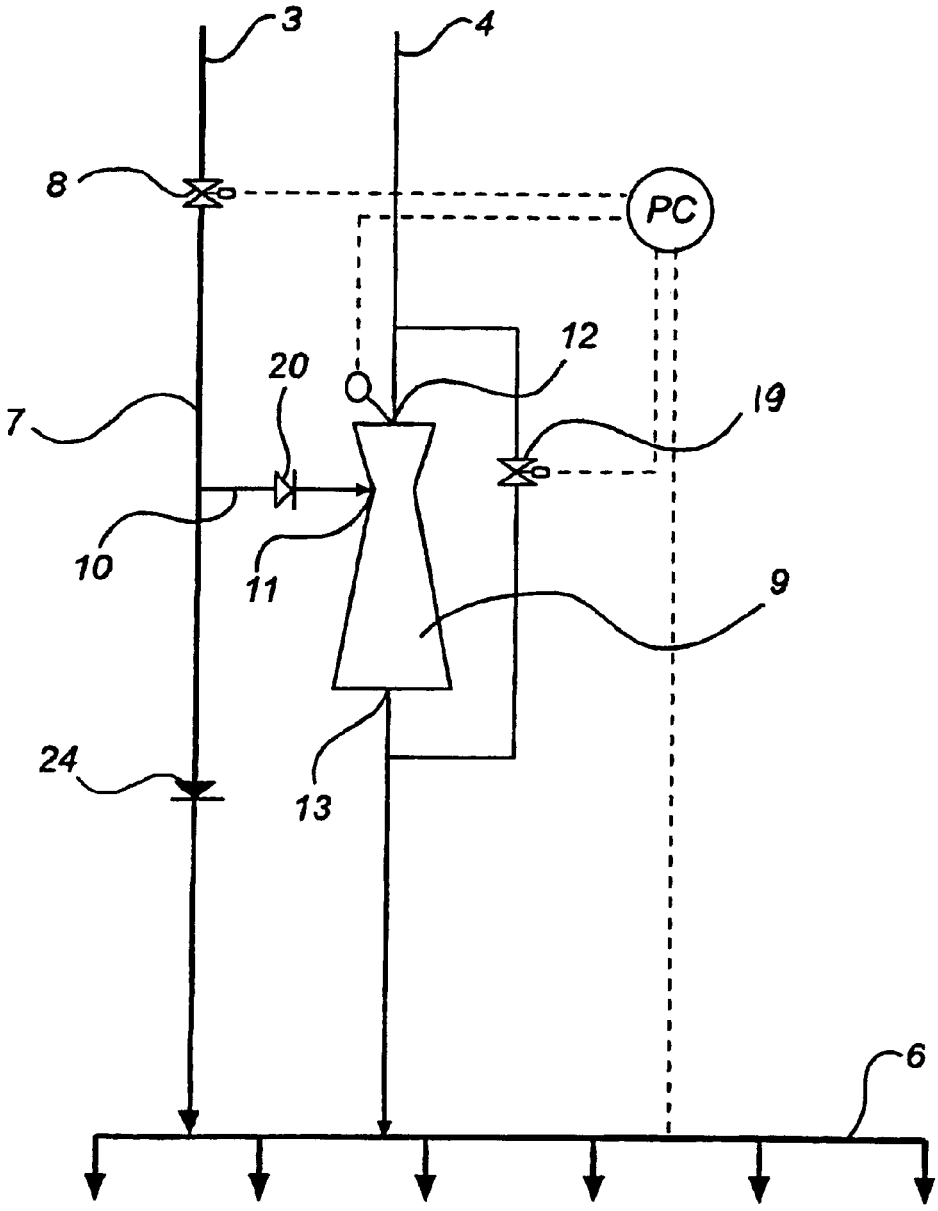
FIGS. 2–5 schematically show how steam is supplied to each of the steam groups according to the invention at different needs of pressure and flow.

As seen in FIG. 2, in normal operation a main steam flow of low-pressure steam is conducted via a main steam pipe 7 to the respective steam groups 6. The steam flow in the main steam pipe 7 is adjustable by means of a valve 8.

Figure 3:
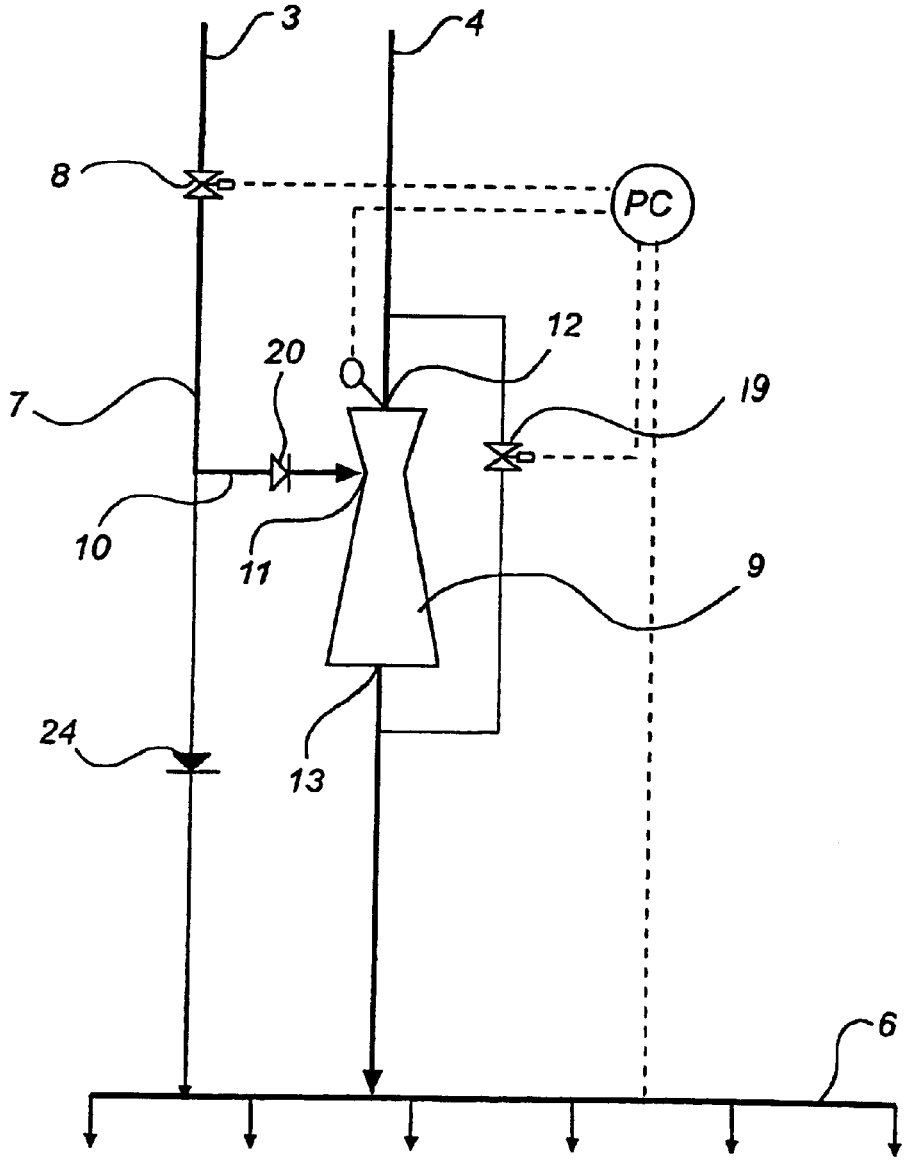

When the so-called drying limitation occurs in the pulp or paper machine, the main steam flow in the main steam pipe 7 is conducted to a thermocompressor 9, as shown in FIG. 3. The thermocompressor 9 has a suction inlet 11, an inlet 12 for motive steam and an outlet 13 for output steam. The main steam flow is conducted from the main steam pipe 7 via a branch 10 between the main steam pipe 7 to the suction inlet 11 of the thermocompressor 9. The thermocompressor 9 is driven by motive steam which is normally supplied from the intermediate-pressure steam pipe 4. The motive steam constitutes 10–75% and the suction steam constitutes 90–25% of the total steam flow to the steam group 6. The chosen relation depends on the desired pressure, the higher the desired pressure the higher the amount of motive steam. A high pressure of the motive steam reduces the need of motive steam. In order to avoid the risk of an undesired circular flow and other undesired steam flows in the system, one check valve 24 is arranged in the main steam pipe 7 and another check valve 20 in the branch 10. By means of the valve 20, any steam flow from the thermocompressor 9 to the main steam pipe 7 is prevented.

In a conventional pulp or paper machine, the drying cylinders 6 are dimensioned to stand a pressure of up to about 0.7 MPa and usually a pressure of at least about 0.1 MPa is required to obtain satisfactory heating. The maximum permissible pressure can, however, vary considerably depending on the type of paper machine and the age of the drying cylinders. In a board machine, the maximum permissible pressure can be 1.2 MPa, in a new fine paper machine 0.5–0.7 MPa and in an older fine paper or news-print machine down to 0.2 MPa. To summarise, pressures in the range of 0.1–1.2 MPa are common. Usually the pressure is allowed to vary in the range of 0.3–0.5 MPa.

Figure 4:
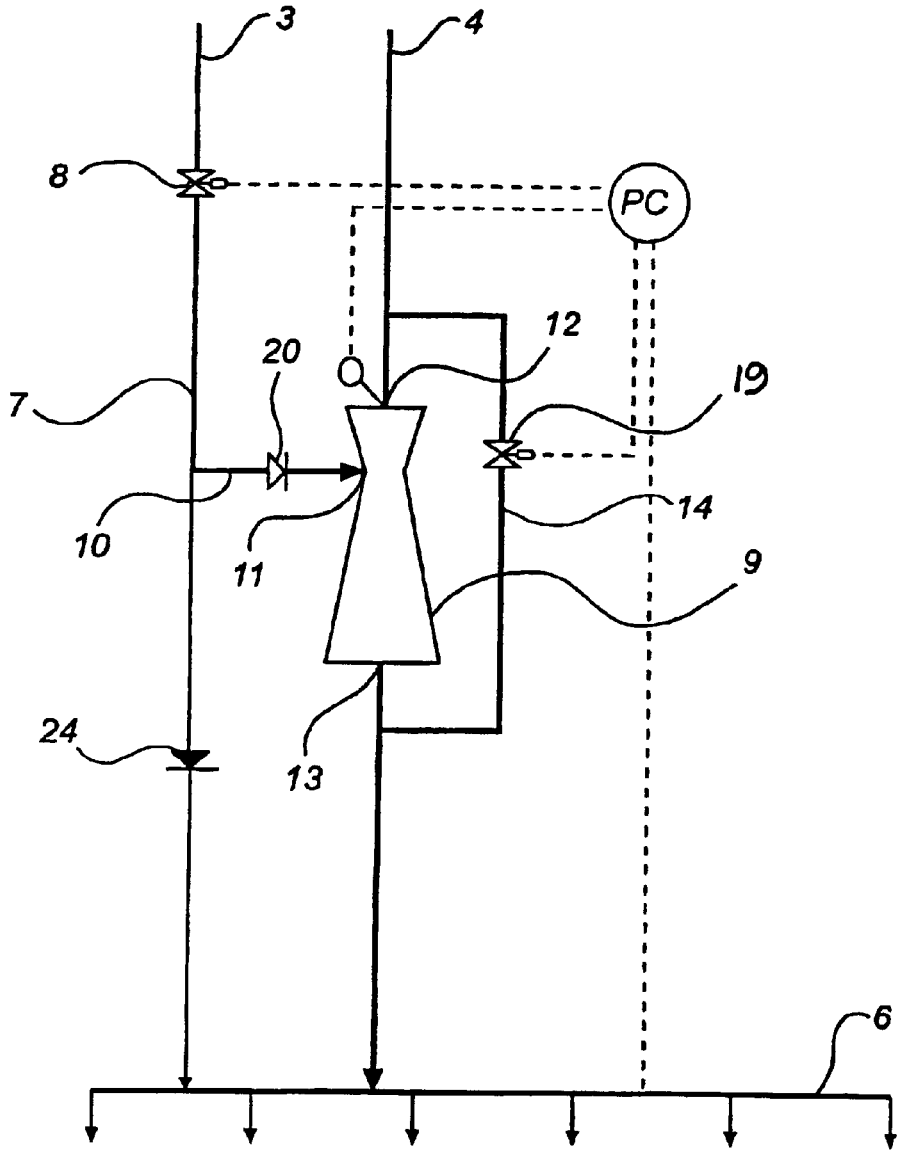

To obtain a further increased pressure or flow, intermediate-pressure steam can be supplied directly to the steam group 6, as shown in FIG. 4. This is done via a pipe 14 which is arranged to lead some of the intermediate-pressure steam past the thermocompressor 9 directly to the steam group 6. In the pipe 14, a throttle valve 19 is arranged which is connected in parallel to the first thermocompressor 9.

Figure 5:
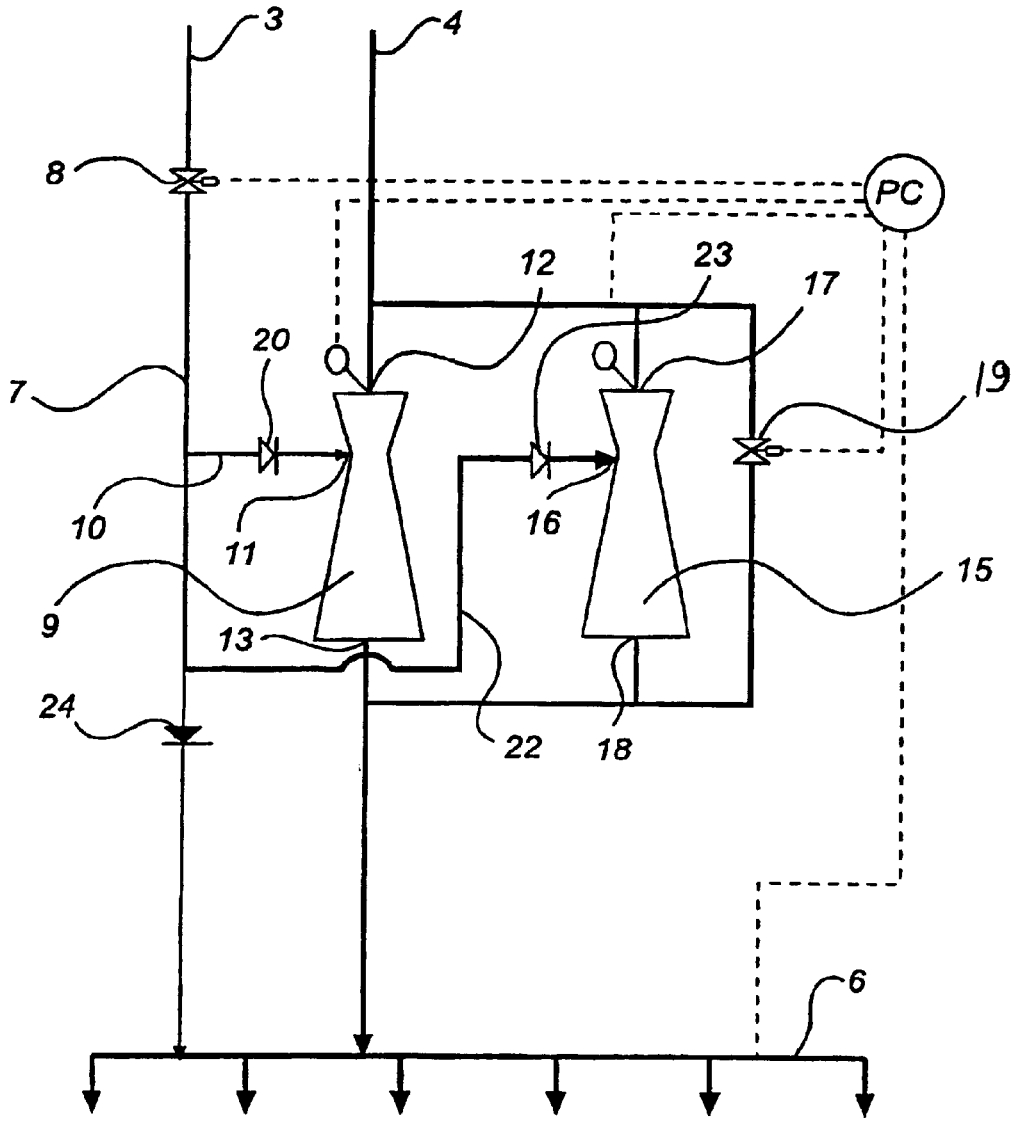

However, in some pulp or paper machines the need often exceeds the capacity of the first thermocompressor 9. To use intermediate-pressure steam and to throttle the flow so that the pressure drops is associated with great energy loss. As an alternative or complement to the direct by-pass of intermediate-pressure steam, it is possible, as seen in FIG. 5, to conduct some of the main steam flow to a second thermocompressor 15 which is connected in parallel to the first thermocompressor 9. The second thermocompressor 15 has an inlet 16 for low-pressure steam, an inlet 17 for motive steam and an outlet 18. They correspond to the inlets 11,12 and the outlet 13 of the first thermocompressor 9. The steam from the main steam pipe is supplied via a pipe 22 in which a valve 23, corresponding to valve 20 in pipe 14, is arranged.

There is also a valve 24 in the main steam pipe 7 downstream of the branch 10 (and the branch 22 if present), which valve is arranged to prevent a steam flow from the steam group 6 into the main steam pipe 7, which could occur when the steam in the steam group 6 has a pressure exceeding the steam pressure in the main steam pipe 7. The valves 20, 23 and 24 can easily be provided by means of so-called check valves.

Technically, it is not necessary to install an extra thermocompressor or by-pass to be able to obtain high pressure. It is instead a question of optimisation, taking into consideration the technical function, investment costs and operative expenses, the operative expenses mostly depending on the loss of electric power production, whether a second thermocompressor and by-pass of intermediate-pressure steam should be used.

It will be understood that a number of modifications of the above-described embodiments of the invention are possible within the scope of the invention, which is defined in the appended claims.

It is, for instance, possible to lead the steam directly from the boiler 1 and use it as motive steam in the thermocompressor 9. The pressure of the motive steam can thus vary between about 1–6 MPa. Furthermore, additional thermocompressors can be connected in parallel to the first and second thermocompressor 9 and 15.

What is claimed is:

1. A method for increasing the drying capacity of a steam group in a drying section of a pulp or paper machine, feeding a main steam flow having a first steam pressure to the steam group, conducting the main steam flow to at least one thermocompressor, the at least one thermocompressor being driven by motive steam having a second steam pressure which is higher than the first steam pressure, and feeding the output steam of the at least one thermocompressor to the steam group, the steam pressure of the output steam that is fed to the steam group being higher than the first steam pressure.

2. A method as claimed in claim 1, wherein some of the motive steam is led past the at least one thermocompressor directly to the steam group.

3. A method as claimed in claim 1, wherein the entire main steam flow is conducted to a first thermocompressor.

4. A method as claimed in claim 1, wherein the main steam flow is conducted to a first thermocompressor and a second thermocompressor which is connected in parallel to the first thermocompressor.

5. A method as claimed in claim 1, wherein a ratio of the flow of motive steam and the flow of main flow steam to the at least one thermocompressor is between 1:9 and 3:1.

6. A method as claimed in claim 1, wherein the pressure of the motive steam has a value in the range of 0.5–6 MPa.

7. A method as claimed in claim 1, wherein the pressure of the main steam flow has a value in the range of 0.1–0.6 MPa.

8. A method as claimed in claim 1, wherein the total steam pressure in the steam group has a value in the range of 0.1–1.2 MPa.

9. A device for increasing the drying capacity of a steam group in a drying section of a papermaking machine, comprising:

a main steam pipe for supplying a main steam flow to the steam group, at least one thermocompressor having an inlet for steam with a first steam pressure, an inlet for motive steam with a second steam pressure and an outlet for output steam, which outlet is connected to the steam group, a steam pipe for supplying motive steam to the motive steam inlet of the at least one thermocompressor, a branch, between the main steam pipe and the inlet of the at least one thermocompressor for steam with a first steam pressure, for conducting the main steam flow to the at least one thermocompressor.

10. A device as claimed in claim 9 which further comprises a pipe which is arranged to lead some of the motive steam past the at least one thermocompressor directly to the steam group.

11. A device as claimed in claim 9, which comprises a first thermocompressor to which the entire main steam flow is conducted.

12. A device as claimed in claim 9, which comprises a first thermocompressor and a second thermocompressor which is connected in parallel to the first thermocompressor.

13. A method as claimed in claim 2, wherein the entire main steam flow is conducted to a first thermocompressor.

14. A method as claimed in claim 2, wherein the main steam flow is conducted to a first thermocompressor and a second thermocompressor, which is connected in parallel to the first thermocompressor.

15. A method as claimed in claim 13, wherein the main steam flow is conducted to a first thermocompressor and a second thermocompressor, which is connected in parallel to the first thermocompressor.

16. A method as claimed in claim 2, wherein a ratio of the flow of motive steam and the flow of main flow steam to the at least one thermocompressor is between 1:9 and 3:1.

17. A method as claimed in claim 2, wherein the pressure of the motive steam has a value in the range of 0.5–6 MPa.

18. A method as claimed in claim 2, wherein the pressure of the main steam flow has a value in the range of 0.1–0.6 MPa.

19. A device as claimed in claim 10, which comprises a first thermocompressor to which the entire main steam flow is conducted.

20. A device as claimed in claim 10, which comprises a first thermocompressor and a thermocompressor which is connected in parallel to the first thermocompressor.

* * * * *

UNITED STATES PATENT AND TRADEMARK OFFICE

CERTIFICATE OF CORRECTION

PATENT NO. : 6,782,638 B1
DATED : August 31, 2004
INVENTOR(S) : Torsten Svenland It is certified that error appears in the above-identified patent and that said Letters Patent is hereby corrected as shown below:

Column 8,
Line 15, add the following additional claim:

21. A device as claimed in claim 9, wherein the pressure of the output steam is greater than the first pressure.

Signed and Sealed this

Twenty-second Day of February, 2005

JON W. DUDAS
*Director of the United States Patent and Trademark Office*